United States Patent [19]

Knierim

[11] 4,348,879

[45] Sep. 14, 1982

[54] SECURITY DEVICE

[76] Inventor: Donald V. Knierim, 866 S. Cavalier Dr., Springfield, Mo. 65804

[21] Appl. No.: 204,794

[22] Filed: Nov. 7, 1980

[51] Int. Cl.[3] ..... E05B 65/00; E05C 17/44

[52] U.S. Cl. ..... 70/93; 70/94; 292/338; 292/207; 292/DIG. 15

[58] Field of Search ..... 70/93, 94, 100; 292/DIG. 15, 338, 342, 207, 210, 196, 153, 150

[56] References Cited

U.S. PATENT DOCUMENTS

| | | | |
|---|---|---|---|
| 561,373 | 6/1896 | Campbell | 292/338 X |
| 998,420 | 7/1911 | Stein | 292/153 |
| 1,054,151 | 2/1913 | Troetel | 292/338 |
| 1,185,547 | 5/1916 | Rugar | 292/338 |
| 1,264,181 | 4/1918 | Hatch | 292/207 |
| 1,770,812 | 7/1930 | Seaman | 70/14 |
| 1,895,146 | 1/1933 | Brown | 292/DIG. 15 X |
| 1,966,612 | 7/1934 | Cochran | 292/338 |
| 2,122,312 | 6/1938 | Cassion | 292/342 |
| 3,805,322 | 4/1974 | Serrano | 292/DIG. 15 X |
| 4,114,936 | 9/1978 | Dominguez | 292/342 |

FOREIGN PATENT DOCUMENTS

| | | | |
|---|---|---|---|
| 962851 | 2/1975 | Canada | 70/93 |
| 566650 | 12/1932 | Fed. Rep. of Germany | 292/210 |
| 486871 | 11/1953 | Italy | 292/153 |
| 1358603 | 7/1974 | United Kingdom | 292/DIG. 15 |

*Primary Examiner*—Ramon S. Britts
*Assistant Examiner*—Carl F. Pietruszka
*Attorney, Agent, or Firm*—Blair, Brown & Kreten

[57] ABSTRACT

The security device of the present invention is mounted in the floor of a building adjacent the hinge side of a door to be made secure. The security device has elements which can be elevated from their storage position to engage against the inner face of the door to prevent the door from being opened beyond a minimum amount. A lock is provided for holding the elements in their elevated position.

4 Claims, 6 Drawing Figures

SECURITY DEVICE

BACKGROUND OF THE INVENTION

The present invention relates to security devices for preventing a door from opening beyond a minimum amount.

In the instant security device a housing is set into the floor adjacent the inner side of a door. A pair of arms are provided which can elevate from the housing into a position preventing the door from being opened beyond a minimum amount. A lock secures the arms in their elevated position.

OBJECTS AND SUMMARY OF THE INVENTION

The primary object of the invention is to provide a security device which can be locked in position and which will permit the door to be opened a minimum amount so that the person outside the door may be seen and talked with without permitting his entrance.

Other objects and advantages will become apparent in the following specification when considered in light of the attached drawings.

DESCRIPTION OF THE PREFERRED EMBODIMENT

Figure 1:
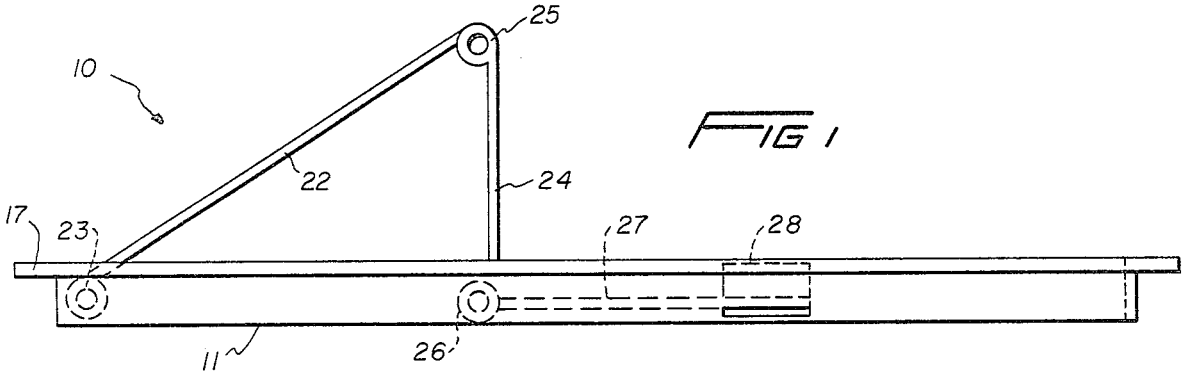
FIG. 1 is a side elevation of the invention.
Figure 2:
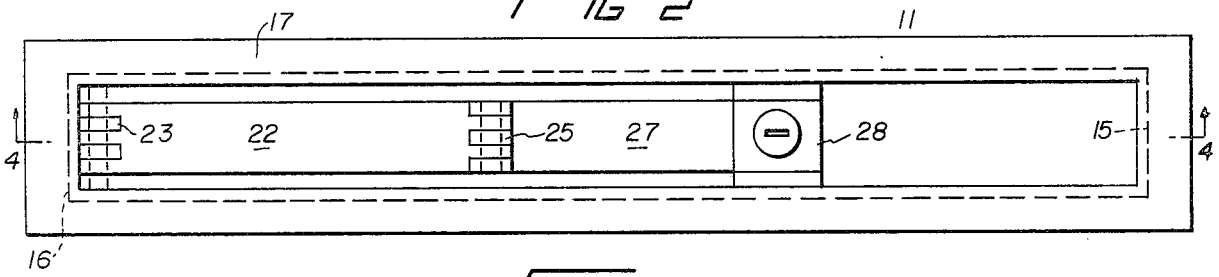
FIG. 2 is a top plan view of the invention.
Figure 3:
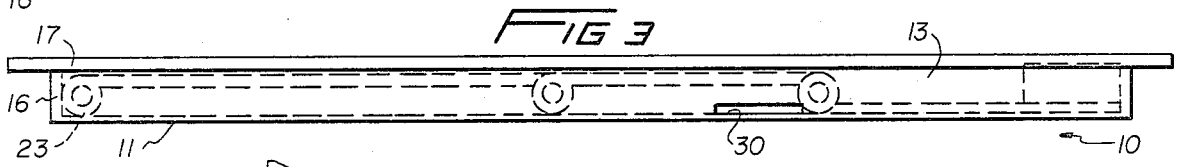
FIG. 3 is a view similar to FIG. 1 with the arms in stored position.

Referring now to the drawings in detail wherein like reference characters indicate like parts throughout the several figures the reference numeral 10 indicates generally a security device constructed in accordance with the invention.

The security device 10 includes a generally rectangular open top housing 11 having a bottom wall 12, a pair of upstanding side walls 13–14 and a pair of opposite end walls 15–16. The bottom wall 12, side walls 13–14 and end walls 15–16 are all formed integrally. A flange 17 is integrally formed with the upper edges of the side walls 13–14 and the end walls 15–16 and extends perpendicularly outwardly therefrom completely surrounding the housing 11.

Figure 4:
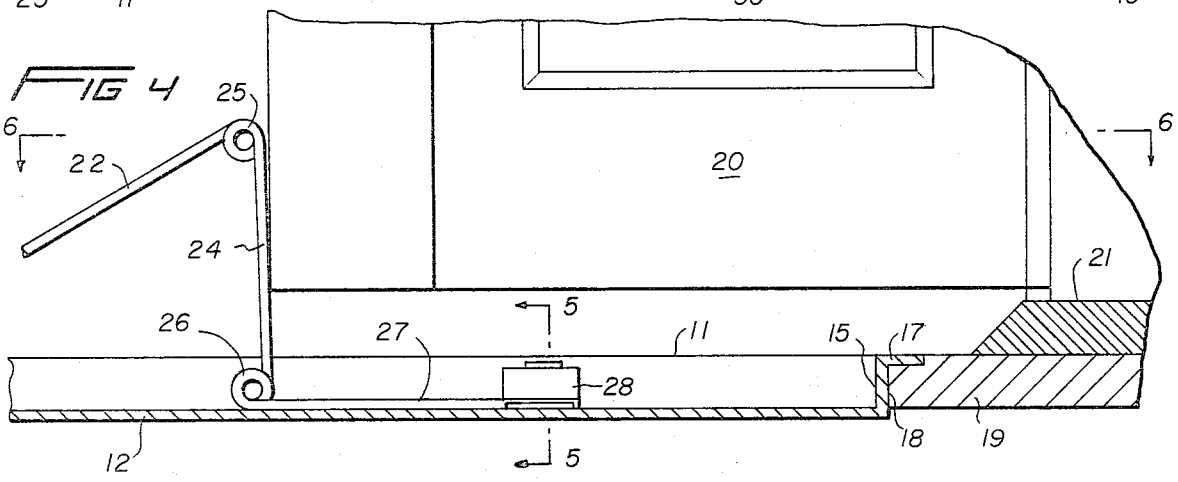
FIG. 4 is a vertical sectional view taken along the line 4—4 of FIG. 2 with a door shown engaging the arms.
Figure 5:
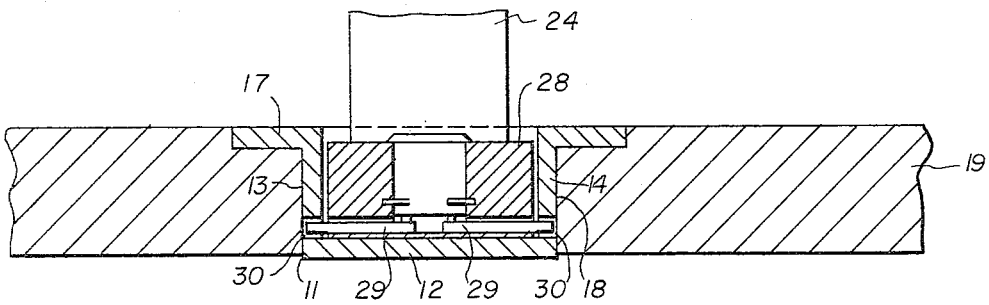
FIG. 5 is an enlarged fragmentary transverse sectional view taken along the line 5—5 of FIG. 4 looking in the direction of arrows.

The housing 11 is seated in an opening 18 in the floor 19 of a building. The housing 11 is closely adjacent the hinge side of a door 20 which closes against a sill 21 as can be best seen in FIG. 4.

A generally flat arm 22 is secured by a hinge connection 23 in one end of the housing 11 and is adapted to swing from a storage position completely within the housing 11 to an elevated position projecting upwardly therefrom. A second arm 24 is secured by a hinge connection 25 to the free end of the arm 22 with the opposite end of the arm 24 extending to a hinge connection 26 connecting the arm 24 to a base arm 27.

A lock 28 is secured to the end of the arm 27 opposite the hinge connection 26 and has a pair of dead bolts 29 which are adapted to be projected into bores 30 in the side walls 13–14 respectively to lock the arm 27 against sliding movement in the housing 11 so as to support the arms 22–24 in an upright position.

In the use and operation of the invention the housing is positioned closely adjacent the hinge side of a door 20 and is secured in the floor 19 by suitable means. With the door 20 closed the arms 22–24 are elevated by sliding the lock 28 and arm 27 along the housing 11 toward the arms 22–24. When the arm 24 becomes generally perpendicular to the floor 19 the lock 28 is actuated to move the dead bolts 29 into the slots 30 of the housing 11 so as to lock the arms 22–24 in their elevated or raised positions. The door 20 can now be swung open an amount controlled by the position of the housing 11 so that a person outside the door can converse with a person in the house without gaining access thereto. The positioning of the housing 11 is such that the user can have access to the lock 28 so as to lock the security device 10 in its secure position with the user out of the building.

To enter the building when the security device is in place the door is opened against the stop so that a key can be inserted into the lock 28 to lower the arms 22–24 and permit the door 20 to be fully opened.

Figure 6:
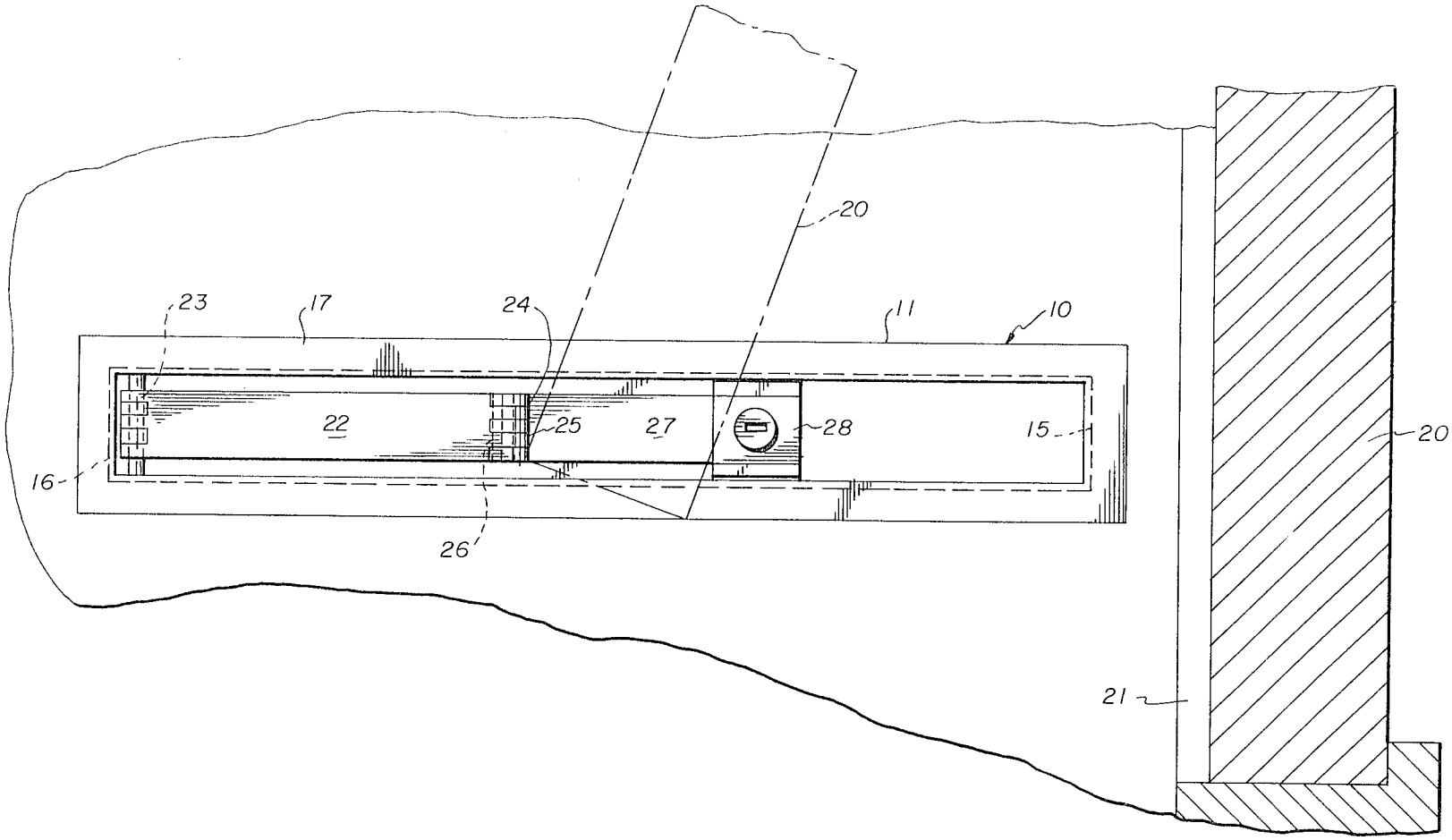
FIG. 6 is a top view taken along lines 6—6 of FIG. 4 showing the door and security device, with an open door in phantom to indicate the lock position and link structure.

FIG. 6 makes it clear that the long side of the housing 11 is perpendicular to the closed door 20, and the phantom door shown there indicates how one would lock and unlock the door security device according to the present invention.

Having thus described the preferred embodiment of the invention it should be understood that numerous structural modifications and adaptations may be resorted to without departing from the spirit of the invention.

What is claimed is:

1. A security device for limiting the amount of travel of a hinged swinging door comprising a housing which defines a trackway perpendicular to said door when it is closed, said housing being recessed in a floor proximate to said door so that the top portion of said housing is substantially flush with said floor, slots in said housing, lock means slideably disposed within said housing oriented so that said lock means can engage and be retained by said slots, and linkage means connected to said lock means which define upstanding projections when said lock is engaged thereby providing a barrier that said door would abut against thereby thwarting an unauthorized entry through said door, and when said lock is disengaged and slid along said trackway said linkage means collapses into said housing, wherein said linkage means includes three arms serially disposed and hingedly interconnected with the outer arms at their opposite respective extremities respectively hinged to said housing and fixed to said lock.

2. The device of claim 1 wherein said housing is formed with a bottom wall, a pair of upstanding side walls, and end walls integral therewith defining an open topped housing.

3. The device of claim 2 including a peripheral flange extending orthogonally from top edges of said side and end walls adapted to nest flush with the floor.

4. The device of claim 1 wherein said slots are provided in said side walls and said lock means includes laterally extensible dead bolts oriented to enter said slots to provide locking.

* * * * *